US005662169A

United States Patent [19]

Hosie

[11] Patent Number: 5,662,169

[45] Date of Patent: Sep. 2, 1997

[54] CUTTINGS INJECTION WELLHEAD SYSTEM

[75] Inventor: Stanley Hosie, Aberdeenshire, Scotland

[73] Assignee: ABB Vetco Gray Inc., Houston, Tex.

[21] Appl. No.: 607,986

[22] Filed: May 2, 1996

[51] Int. Cl.[6] ..... E21B 41/04

[52] U.S. Cl. ..... 166/344; 166/89.1; 166/382; 175/207; 405/128

[58] Field of Search ..... 166/86.3, 88.4, 166/89.1, 75.15, 90.1, 344, 368, 381, 382; 175/66, 206, 207; 405/128; 588/250

[56] References Cited

U.S. PATENT DOCUMENTS

| | | | |
|---|---|---|---|
| 4,942,929 | 7/1990 | Malachosky | 175/66 |
| 5,085,277 | 2/1992 | Hopper | 166/341 |
| 5,109,933 | 5/1992 | Jackson | 175/66 |
| 5,129,469 | 7/1992 | Jackson | 175/66 |
| 5,339,912 | 8/1994 | Hosie | 175/66 |

OTHER PUBLICATIONS

One page of drawing entitled "Drill–Quip Wellhead Drawing" (undated).

One page article, entitled, "Conductor Connectors" (undated).

*Primary Examiner*—David J. Bagnell

*Attorney, Agent, or Firm*—James E. Bradley

[57] ABSTRACT

A wellhead system has features which allow the injection of drilling cuttings in an annulus between first and second strings of casing. A wellhead assembly has an outer wellhead housing connected to a string of conductor pipe. An outer port is located in the sidewall of an extension member located below the outer wellhead housing. An inner wellhead housing lands in the outer wellhead housing. An inner port is located in an extension member below the inner wellhead housing. An internal landing shoulder is located within the conductor pipe. An external landing shoulder is located on a swivel connector joint mounted on the upper end of a first string of casing. The connector joint is secured to the inner wellhead housing extension member. Once landed, the landing shoulder on the connecting joint supports the weight of casing, allowing the inner wellhead housing to be rotated to orient the inner port with the outer port. The inner wellhead housing then may be moved downward a short distance to lock it into engagement with the outer wellhead housing.

11 Claims, 2 Drawing Sheets

CUTTINGS INJECTION WELLHEAD SYSTEM

BACKGROUND OF THE INVENTION

1. Field of the Invention

This invention relates in general to equipment for pumping cuttings generated from drilling a subsea well back into another subsea well, and in particular to an adapter that connects an injection line to the inner wellhead housing.

2. Description of the Prior Art

When a subsea well is drilled, cuttings, which are small chips and pieces of various earth formations, will be circulated upward in the drilling mud to the drilling vessel. These cuttings are separated from the drilling mud and the drilling mud is pumped back into the well, maintaining continuous circulation while drilling. The cuttings in the past have been dumped back into the sea.

While such practice is acceptable for use with water based drilling muds, oil based drilling muds have advantages in some earth formations. The cuttings would be contaminated with the oil, which would result in pollution if dumped back into the sea. As a result, environmental regulations now prohibit the dumping into the sea cuttings produced with oil based drilling mud.

There have been various proposals to dispose of the oil base cuttings. One proposal is to inject the cuttings back into a well. The well could be the well that is being drilled, or the well could be an adjacent subsea well. Various proposals in patents suggest pumping the cuttings down an annulus between two sets of casing into an annular space in the well that has a porous formation. The cuttings would be ground up into a slurry and injected into the porous earth formation. Subsequently, the well receiving the injected cuttings would be completed into a production well.

U.S. Pat. No. 5,085,277, Feb. 4, 1992, Hans P. Hopper, shows equipment for injecting cuttings into an annulus surrounding casing. The equipment utilizes piping through the template or guide base and through ports in specially constructed inner and outer wellhead housings. Orientation of the inner wellhead housing with the outer wellhead housing is required to align the ports. In the '277 patent, orientation is not discussed, but it appears that it would require rotating the string of casing attached to the inner wellhead housing, which would be difficult. Another known injection system avoids having to rotate the string of casing attached to the inner wellhead housing by running the casing first, supporting it on a landing ring, then in a second trip running the inner wellhead housing assembly. The inner wellhead assembly has a port which is oriented. Then the inner wellhead assembly is secured to the string of casing. While workable, this requires two trips to run the inner wellhead housing and string of casing, which is time consuming for deep water drilling.

SUMMARY OF THE INVENTION

The wellhead system of this invention has an outer port which is located in the outer wellhead assembly made up of the outer wellhead housing and conductor pipe. An inner port is located in an inner wellhead assembly made up of the inner wellhead housing and a first string of casing. An internal landing shoulder is located in the outer wellhead assembly below the ports. An external landing shoulder is located on the inner wellhead assembly below the inner port. The external landing shoulder lands on the internal landing shoulder and supports the weight of the first string of casing.

A connector joint is connected between the first string of casing and inner wellhead housing. The connector joint supports tension to lower the first string of casing with the inner wellhead housing until being supported by the internal landing shoulder. The connector joint is capable of rotational movement, allowing the inner wellhead housing to be rotated relative to the first string of casing to orient the inner port with the outer port. The connector joint allows the inner wellhead housing to be locked to the outer wellhead housing after the ports have been aligned. Preferably, this locking movement is performed by forcing the inner wellhead housing further downward into wedging engagement with the outer wellhead housing.

A conduit is connected to the outer port for delivering disposal cuttings to the annulus. Preferably, the conduit is moved horizontally into a stabbing engagement by a hydraulic cylinder. A disposal line from the drilling vessel stabs vertically into another end of the conduit. Cuttings may then be pumped into an annulus between the first and second strings of casing.

DETAILED DESCRIPTION OF THE PREFERRED EMBODIMENT

Figure 1:
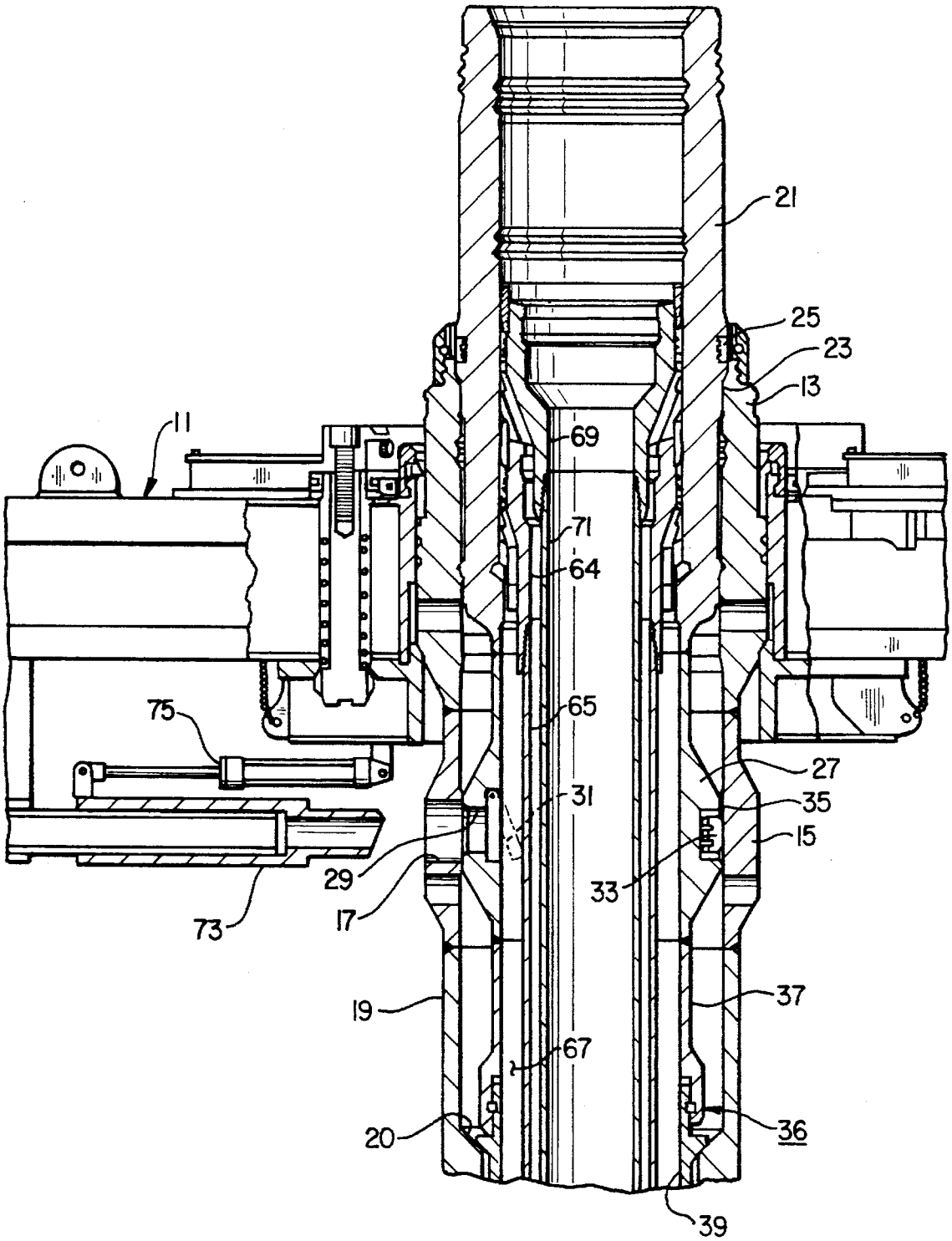
FIG. 1 is a sectional view of a wellhead system having a cuttings injection system constructured in accordance with this invention.

Referring to FIG. 1, a guide base 11 and outer wellhead housing 13 will be positioned on the sea floor below a floating drilling vessel (not shown). Outer wellhead housing 13 is a large tubular member having a bore located on a vertical axis. An extension member 15 is welded to the lower end of outer wellhead housing 13 and may be considered a part of outer wellhead housing 13. Extension member 15 is a tubular member having a flow port 17 extending through its sidewall for injecting cuttings. A conductor pipe 19 is secured to the lower end of extension member 15 and extends downward several hundred feet in the well. Conductor pipe 19 is typically 30 inches in diameter. In the preferred embodiment, extension member 15 is of thicker cross section than conductor pipe 19. An internal landing shoulder 20 is located within the bore of conductor pipe 19 a short distance below extension member 15. Outer wellhead housing 13, extension member 15, and conductor pipe 19 form an outer wellhead assembly which is usually run along with guide base 11.

After the installation of outer wellhead housing 13, the well is drilled to a second depth below conductor pipe 19, and inner wellhead housing 21 is installed. Inner wellhead housing 21 is a large tubular member that fits securely within the bore of outer wellhead housing 13 and protrudes above. Inner wellhead housing 21 is capable of withstanding higher pressures than outer wellhead housing 13. Inner wellhead housing 21 has two spaced-apart wedge surfaces 23 which will wedge against mating surfaces in the bore of wellhead housing 13. Once wedged in place, a lock ring 25 on the exterior of inner wellhead housing 21 engages mating grooves on the upper end of outer wellhead housing 13.

Inner wellhead housing 21 also has an extension member 27 extending below it which may be considered a part of inner wellhead housing 21. Extension member 27 extends to about the same depth as outer wellhead housing extension member 15. Extension member 27 has an inner flow port 29 that is positioned to align with outer flow port 17. A flapper valve 31 is mounted to inner flow port 29 to open only when external pressure is applied. An orientation key 33 is mounted by springs to an extension member 27. Key 33 will snap into a vertical slot 35 when flow ports 17, 29 are rotated into alignment with each other.

Figure 2:
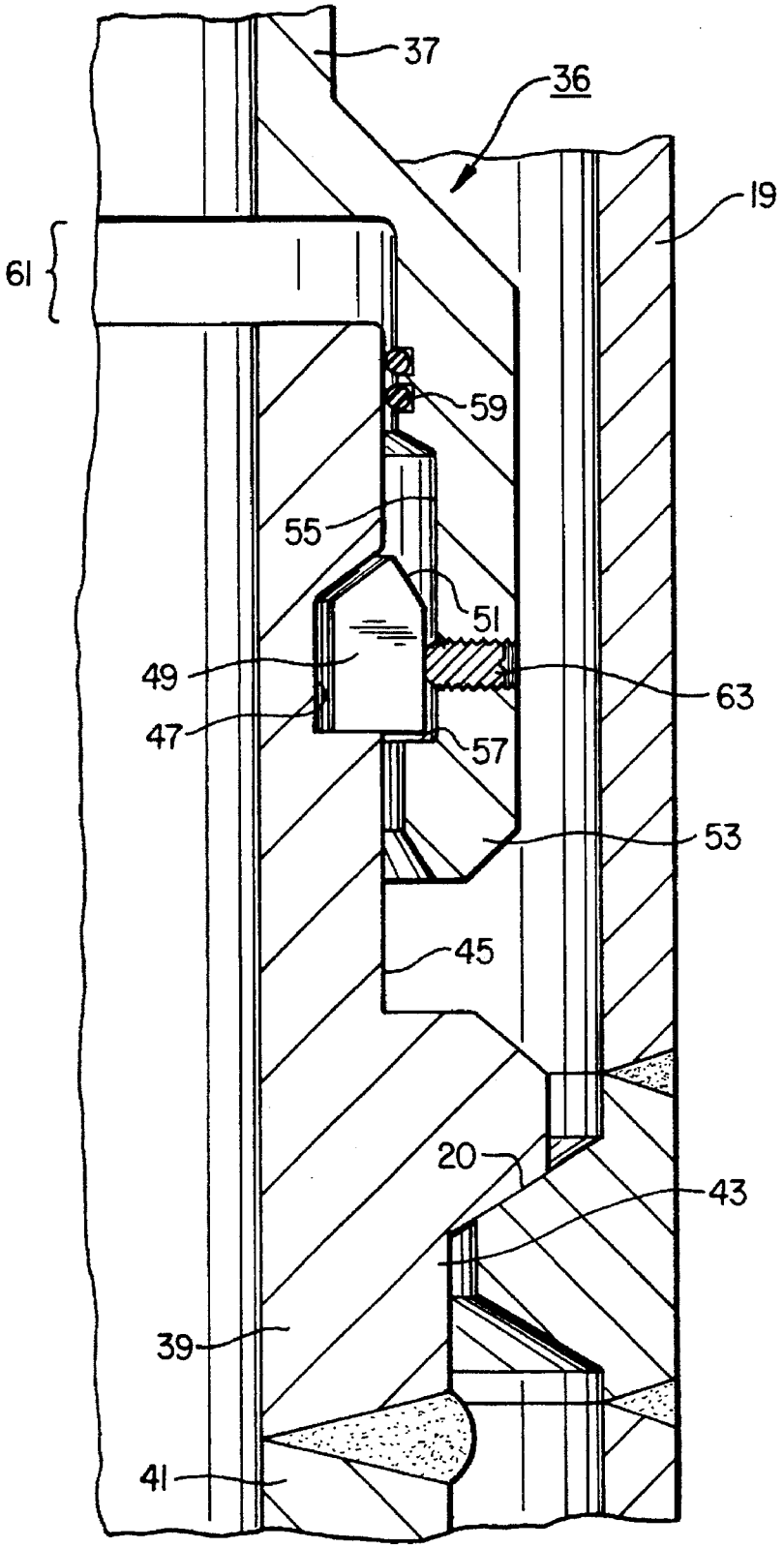
FIG. 2 is an enlarged sectional view of a portion of the connector joint employed with the wellhead system of FIG. 1.

A connector joint 36 is welded to the lower end of extension member 27. Connector joint 36 has an upper portion 37 and a lower portion 39. Referring to FIG. 2, lower portion 39 is welded to the upper end of a first string of casing 41. Inner wellhead housing 21, extension member 27, connector joint 36 and casing 41 comprise an inner wellhead assembly. An external landing shoulder 43 is formed on connector joint lower portion 39. External landing shoulder 43 will land on internal landing shoulder 20 before wedge surfaces 23 are in engagement.

Connector joint lower portion 39 has an upward extending cylindrical inner wall 45 that extends upward from external landing shoulder 43. A lock ring groove 47 is formed in the exterior of inner wall 45. A split ring 49 is carried within groove 47. Split ring 49 is biased to be larger in diameter than the outer diameter of inner wall 45. Split ring 49 has a conical upper exterior shoulder 51.

Connector joint upper portion 37 has an outer wall 53 that will slide over inner wall 45. Outer wall 53 has an internal groove 55 into which split ring 49 will locate. Groove 55 has a lifting shoulder 57 on its lower edge that engages the lower edge of split ring 49 to transmit tension. Seals 59 are located above split ring 49 and sealed between inner wall 45 and outer wall 53. The axial dimension of groove 55 is larger than the axial dimension of split ring 49. Similarly, a clearance 61 is located between the upper rim of inner wall 45 and outer wall 53. A similar clearance exists between the lower rim of outer wall 53 and external landing shoulder 43. Clearance 61 allows inner wellhead housing 21 (FIG. 1) to be wedged downward into locking engagement with outer wellhead housing 13 after landing shoulder 43 has landed on landing shoulder 20.

A release screw 63 is located in outer wall 53. Release screw 63 can be rotated inward to radially contract split ring 49 within groove 47 sufficiently for lifting shoulder 57 to clear split ring 49. This allows one to disassemble upper portion 37 from lower portion 39 if desired. During assembly, the lower end of outer wall 53 will contact upper corner 51, contracting split ring 49 sufficiently for outer wall 53 to snap over split ring 49.

To install the wellhead system to the point described, guide base 11 and outer wellhead housing 13 will be run along with conductor pipe 19. The operator will drill the well to second depth and lower first string of casing 41 (FIG. 2). The operator welds the lower portion 39 of connector joint 36 to the upper end of casing 41. Inner wellhead housing 21, extension member 27, and the upper portion 37 of connector joint 36 will have previously been welded together as an assembly. The operator picks up this assembly and connects it to casing string 41 by assembling the upper portion 37 with the lower portion 39 of connector 36. The operator then lowers the string of casing 41 along with the assembly of wellhead housing 21. While lowering, lifting shoulder 57 and split ring 49 (FIG. 2) support the weight of the string of casing 41. As inner wellhead housing 21 slides into the bore of outer wellhead housing 13, landing shoulder 43 will land on internal landing shoulder 20 prior to wedging surfaces 23 engaging each other. The weight of casing 41 will now be supported by lower portion 39 of connector joint 36.

The operator then rotates inner wellhead housing 21. Because of the weight of casing 41, lower portion 39 of connector joint 36 will not rotate. Inner wellhead housing 21 is free to rotate because wedge surfaces 23 have not yet come into full engagement with each other. The operator rotates inner wellhead housing 21 until key 33 (FIG. 1) snaps into slot 35. At this point, inner flow port 29 will be rotationally aligned with outer flow port 17.

The operator now locks inner wellhead housing 21 to outer wellhead housing 13. In the preferred embodiment, this is performed with a running tool that applies a large downward force on inner wellhead housing 21 while pulling upward on outer wellhead housing 13. One suitable tool is described in U.S. Pat. No. 5,188,180, Feb. 23, 1993, Jennings. This causes axial downward movement that is slightly less than the clearance 61 (FIG. 2). Lock ring 25 will fully engage mating teeth in outer wellhead housing 13. Wedge surfaces 23 will fully engage each other. Inner wellhead housing 21 is now rigidly locked to outer wellhead housing 13. Clearance 61 (FIG. 2) will decrease to a considerably smaller amount than as shown in the position in FIG. 2.

The operator then will drill the well conventionally to even greater depths and install conventional equipment including a casing hanger 64 secured to a second string of casing 65. An annulus 67 will be defined between the first string of casing 41 and the second string of casing 65. Also, the well may be drilled to an even greater depth, with an upper casing hanger 69 landing in inner wellhead housing 21 and supporting a third string of casing 71.

A conduit will be coupled to outer flow port 17. In the preferred embodiment, the coupling means includes a horizontal stab 73 that stabs into the aligned ports 17, 29, pushing back flapper valve 31. A hydraulic cylinder 75 is employed to move horizontal stab 73 between the retracted position shown and an engaged position within flow ports 17, 29. Also, although not shown, a vertical stab will be mounted to base 11 for connecting a conduit extending downward from the vessel. The vertical stab leads to a flexible hose (not shown) connected to horizontal stab 73. The operator may now pump a slurry of ground up previously formed drilling cuttings from the drilling vessel into annulus 67.

The invention has significant advantages. The wellhead system allows orientation of lateral disposal ports without requiring rotation of a string of casing. The string of casing and the inner wellhead housing are run together in a single trip.

While the invention is shown in only one of its forms, it should be apparent to those skilled in the art that it is not so limited but is susceptible to various changes without departing from the scope of the invention.

I claim:

1. In a wellhead assembly having an outer wellhead housing connected to a string of conductor pipe, forming an outer wellhead assembly, an inner wellhead housing which lands in the outer wellhead housing and is connected to a first string of casing, forming an inner wellhead assembly, a casing hanger which lands in the inner wellhead housing and is connected to a second string of casing, an improved means for pumping disposal cuttings down an annulus between the first and second strings of casing, comprising in combination:

an outer port in the outer wellhead assembly;

an inner port in the inner wellhead assembly;

an internal landing shoulder in the outer wellhead assembly below the ports;

an external landing shoulder on the inner wellhead assembly below the inner port, which lands on the internal landing shoulder and supports the weight of the first string of casing;

connector joint means for lowering the first string of casing with the inner wellhead housing until landing on the internal landing shoulder, for rotating the inner wellhead housing relative to the first string of casing after the first string of casing is supported on the internal landing shoulder to allow the inner port to be oriented with the outer port, and for allowing the inner wellhead housing to be rigidly locked in the outer wellhead housing after the ports have been aligned; and a conduit which engages the outer port for delivering disposal cuttings to the annulus.

2. The wellhead assembly of claim 1, wherein the connector joint means comprises:

inner and outer overlapping walls, one of the walls being connected to the first string of casing and the other of the walls being connected to the inner wellhead housing:

a snap ring mounted on the inner wall for engaging and snapping into a groove in the outer wall;

a seal located between the inner and outer walls; and the groove having a greater axial dimension than the snap ring, enabling the inner wellhead housing to be wedged downward into the outer wellhead housing after the inner port has been aligned with the outer port.

3. The wellhead assembly according to claim 1, further comprising:

an outward biased alignment key mounted to the inner wellhead assembly; and a mating slot formed in the outer wellhead assembly, the key and slot being positioned to align when the ports are oriented.

4. In a wellhead assembly having an outer wellhead housing connected to a string of conductor pipe, forming an outer wellhead assembly, an inner wellhead housing which lands in the outer wellhead housing and is connected to a first string of casing, forming an inner wellhead assembly, a casing hanger which lands in the inner wellhead housing and is connected to a second string of casing, an improved means for pumping disposal cuttings down an annulus between the first and second strings of casing, comprising in combination:

an outer port in the outer wellhead assembly;

an inner port in the inner wellhead assembly;

an internal landing shoulder in the outer wellhead assembly below the outer port;

a connector joint in the inner wellhead assembly, having an upper portion secured to the inner wellhead housing and a lower portion secured to the first string of casing;

an external landing shoulder on the lower portion of the connector joint below the inner port, which lands on the internal landing shoulder and supports the weight of the first string of casing;

the upper and lower portions of the connector joint being rotatable relative to each other, allowing rotation of the inner wellhead housing and inner port relative to the first string of casing while the first string of casing is supported on the internal landing shoulder to allow the inner port to be oriented with the outer port; and a conduit which couples to the outer port for delivering disposal cuttings to the annulus.

5. The wellhead assembly according to claim 4, wherein the connector joint also allows limited axial movement of the inner wellhead housing relative to the first string of casing, enabling the inner wellhead housing to be preloaded downward and rigidly locked in the outer wellhead housing after the inner port has been aligned with the outer port.

6. The wellhead assembly according to claim 4, wherein the connector joint comprises:

inner and outer overlapping walls, one of the walls being connected to the first string of casing and the other of the walls being connected to the inner wellhead housing:

a snap ring carried on the inner wall for engaging and snapping into a circumferential groove in the outer wall;

a seal located between the inner and outer walls; and the groove having a greater axial dimension than the snap ring, enabling the inner wellhead housing to be preloaded downward into the outer wellhead housing after the inner port has been aligned with the outer port.

7. The wellhead assembly according to claim 4, wherein the inner port is located in the upper portion of the connector joint.

8. The wellhead assembly according to claim 4, further comprising:

an outward biased alignment key mounted to the inner wellhead assembly; and a mating slot formed in the outer wellhead assembly, the key and slot being positioned to align when the ports are oriented.

9. In a wellhead assembly having an outer wellhead housing connected to a string of conductor pipe, forming an outer wellhead assembly, an inner wellhead housing which lands in the outer wellhead housing and is connected to a first string of casing, forming an inner wellhead assembly, a casing hanger which lands in the inner wellhead housing and is connected to a second string of casing, an improved means for pumping disposal cuttings down an annulus between the first and second strings of casing, comprising in combination:

an outer port in the outer wellhead assembly;

an internal landing shoulder in the outer wellhead assembly below the outer port;

an inner port in the inner wellhead assembly;

an upper portion of a connector joint joined to a lower end of the inner wellhead housing and having a lower end extending downward and having an internal groove formed therein;

a lower portion of a connector joint joined to the upper end of the first string of casing, and having an upper end in overlapping sliding engagement with the lower end of the upper portion of the connector joint;

an external landing shoulder on the lower portion of the connector joint which lands on the internal landing shoulder and supports the weight of the first string of casing, allowing the inner wellhead housing and upper portion of the connector joint to be rotated relative to the lower portion of the connector joint and the first string of casing to orient the ports;

an outward biased alignment key mounted to the inner wellhead assembly;

a mating slot formed in the outer wellhead assembly, the key and slot being positioned to align when the ports are oriented;

a split ring carried on the lower portion of the connector joint for engaging and snapping into the groove in the upper portion of the connector joint to support the weight of the first string of casing with the inner wellhead housing prior to landing the external shoulder on the internal shoulder;

a seal located between the overlapping upper and lower ends of the upper and lower portions of the connector joint; and the groove having a greater axial dimension than the snap ring, enabling the inner wellhead housing to be preloaded downward into the outer wellhead housing after the inner port has been aligned with the outer port; and a conduit for coupling to the outer port for delivering disposal cuttings to the annulus.

10. A method of disposing of offshore well drilling cuttings, comprising:

forming a well to a first depth and installing an outer wellhead housing at a subsea floor which is connected to a string of conductor pipe that extends to the first depth, forming an outer wellhead assembly;

providing the outer wellhead assembly with a flow port above the subsea floor and an internal landing shoulder below the flow port;

drilling the well to a second depth;

lowering a first string of casing through the conductor pipe into the well;

providing a connector joint which has upper and lower portions that are rotatable relative to each other and capable of supporting tension;

providing a lower portion of the connector joint with an external landing shoulder and an upper portion of the connector joint with an inner flow port;

securing the lower portion of the connector joint to an upper end of the first string of casing and the upper portion to a lower end of an inner wellhead housing;

lowering the first string of casing and the inner wellhead housing into the outer wellhead housing until the external landing shoulder lands on the internal landing shoulder and supports the weight of the first string of casing; then rotating the inner wellhead housing and upper portion of the connector joint relative to the first string of casing until the inner port is rotationally oriented with the outer port; then locking the inner wellhead housing rigidly to the outer wellhead housing;

drilling the well to a third depth and installing a second string of casing in the well; and connecting a conduit to the outer port and pumping cuttings between the first and second strings of casing.

11. The method according to claim 10 wherein the step of locking the inner wellhead housing rigidly to the outer wellhead housing comprises:

forcing the inner wellhead housing downward in the outer wellhead housing.

* * * * *